US007059302B2

(12) United States Patent
Lemoure

(10) Patent No.: US 7,059,302 B2
(45) Date of Patent: Jun. 13, 2006

(54) METHOD FOR OPERATING A COMMON RAIL FUEL INJECTION SYSTEM FOR INTERNAL COMBUSTION ENGINES

(75) Inventor: Math Lemoure, Ludwigsburg (DE)

(73) Assignee: Robert Bosch GmbH, Stuttgart (DE)

( * ) Notice: Subject to any disclaimer, the term of this patent is extended or adjusted under 35 U.S.C. 154(b) by 40 days.

(21) Appl. No.: 10/504,961

(22) PCT Filed: Jun. 23, 2003

(86) PCT No.: PCT/DE03/02086

§ 371 (c)(1),
(2), (4) Date: Aug. 18, 2004

(87) PCT Pub. No.: WO2004/036034

PCT Pub. Date: Apr. 29, 2004

(65) Prior Publication Data

US 2005/0103313 A1 May 19, 2005

(30) Foreign Application Priority Data

Oct. 11, 2002 (DE) ..... 102 47 564

(51) Int. Cl.
*F02M 37/04* (2006.01)

(52) U.S. Cl. ..... 123/446; 123/467

(58) Field of Classification Search ..... 123/467, 123/446, 447, 456, 514
See application file for complete search history.

(56) References Cited

U.S. PATENT DOCUMENTS

| | | | | |
|---|---|---|---|---|
| 5,941,214 | A | 8/1999 | Hoffmann et al. | |
| 6,253,734 | B1 | 7/2001 | Rembold et al. | |
| 6,293,253 | B1 | 9/2001 | Arnold et al. | |
| 6,367,454 | B1 | 4/2002 | Rembold et al. | |
| 6,510,843 | B1 * | 1/2003 | De Matthaeis | 123/506 |
| 6,568,927 | B1 * | 5/2003 | Guentert | 417/569 |
| 6,581,577 | B1 * | 6/2003 | Geyer | 123/514 |
| 6,694,950 | B1 * | 2/2004 | Djordjevic | 123/446 |
| 6,729,309 | B1 * | 5/2004 | Schueler | 123/514 |
| 6,772,734 | B1 * | 8/2004 | Schueler | 123/446 |
| 6,848,423 | B1 * | 2/2005 | Schmidl et al. | 123/446 |
| 2003/0037768 | A1 * | 2/2003 | Kanne et al. | 123/446 |
| 2003/0089341 | A1 * | 5/2003 | Schueler | 123/458 |
| 2003/0111050 | A1 * | 6/2003 | Schueler | 123/446 |

FOREIGN PATENT DOCUMENTS

| | | |
|---|---|---|
| DE | 196 12 412 A1 | 10/1997 |
| DE | 196 18 932 A1 | 11/1997 |
| DE | 198 34 120 A1 | 2/2000 |
| DE | 198 53 823 A1 | 5/2000 |
| EP | 1 195 514 A2 | 4/2002 |

* cited by examiner

*Primary Examiner*—Carl S. Miller
(74) *Attorney, Agent, or Firm*—Ronald E. Greigg

(57) ABSTRACT

A method for operating a fuel injection system in which in idling or partial-load operation, the pumping performance of the high-pressure fuel pump is made uniform. This has a positive effect on the quietness of engine operation and on the quality of regulation of the pressure in the common rail.

18 Claims, 8 Drawing Sheets

METHOD FOR OPERATING A COMMON RAIL FUEL INJECTION SYSTEM FOR INTERNAL COMBUSTION ENGINES

CROSS-REFERENCE TO RELATED APPLICATIONS

This application is a 35 USC 371 application of PCT/DE 03/02086 filed on Jun. 23, 2003.

BACKGROUND OF THE INVENTION

1. Field of the Invention

The invention relates to a method for operating a fuel injection system of an internal combustion engine, having a high-pressure fuel pump that has a plurality of pump elements, having a metering valve disposed on the intake side of the high-pressure fuel pump, wherein the fuel quantity aspirated by the pump elements is controllable or regulatable by the metering valve, having a common rail, and having a pressure regulating valve; the pressure in the common rail is controlled or regulated by the pressure regulating valve.

2. Description of the Prior Art

Regulating the pumping quantity of high-pressure fuel pumps is of major significance for the overall efficiency of the fuel injection system of internal combustion engines and hence also for the engine fuel consumption. Furthermore, a high-pressure fuel pump whose pumping quantity can be regulated only to a limited extent must have greater reserves by design, which increases the production costs for the high-pressure fuel pump.

It is known from the prior art to limit the fuel quantity aspirated by the pump elements by means of a metering valve on the intake side of the pump elements and thus also to limit the pumping quantity of the high-pressure fuel pump. The pressure in the common rail is regulated by a pressure regulating valve, which as a rule is disposed on the common rail, or by a metering valve.

If the high-pressure fuel pump has a plurality of pump elements and the pumping quantity of the high-pressure fuel pump is reduced sharply by the metering valve, the result is an unequal distribution of the pumping quantity to the pump elements. For instance, it can happen that only two pump elements out of three make a significant contribution to pumping fuel, while a third pump element is de facto out of operation. This effect is unwanted, since it leads to increased pressure fluctuations in the common rail, and furthermore the performance required to drive the high-pressure fuel pump is also subject to major fluctuations. These performance fluctuations, like the aforementioned pressure fluctuations in the common rail, lead to nonconcentric operation of the engine in the partial-load range, and especially in idling.

The method of the invention provides that the fuel quantity flowing through the metering valve is detected; the theoretical pumping volume of the high-pressure fuel pump is detected or calculated; and the pressure regulating valve, if the fuel quantity pumped is less than a predetermined minimum pumping quantity, is triggered such that a defined leakage occurs.

SUMMARY AND ADVANTAGES OF THE INVENTION

By the method of the invention, in the partial-load ranges that are critical to smooth operation of the engine, with a fill factor of the pump elements of less than 30%, for instance, this fill factor can be increased by providing that a defined leakage is established at the pressure regulating valve of the common rail. Because of the increase in the fill factor of the pump elements, the difference between the pumping quantities of the various pump elements decreases, which makes itself felt favorably in a more-constant pressure in the common rail and improved concentricity of the engine.

The method of the invention can be applied to the most various types of high-pressure fuel pumps and in particular does not require a high-pressure fuel pump with a spring, integrated with the pumping chamber of the pump elements, of the intake valve of the pump elements. For this reason, the method of the invention makes no special demands of the high-pressure fuel pump or the fuel injection system.

Moreover, the method of the invention requires no additional data; instead, it can be performed on the basis of data processed anyway by a control unit of a fuel injection system, such as the engine rpm, the flow quantity through the metering valve, and the like. For this reason, no additional sensors need to be installed in the engine or the fuel injection system, which also contributes to reducing costs.

It has been demonstrated in measurements that with the aid of the method of the invention, smooth operation of the engine in idling was attainable and was approximately equivalent to that of a radial piston pump whose intake valve springs are disposed in the pumping chamber of the pump elements. This mechanically relatively complicated embodiment, because of the necessarily enlarged idle volume, has poorer efficiency than a high-pressure fuel pump in which the intake valve springs are not disposed in the pumping chamber. Since the method of the invention makes it possible to use the high-pressure fuel pump without intake valve springs in the pumping chamber, the use of the method of the invention leads to an improvement of the efficiency of the fuel injection system by up to 10 percentage points in all operating ranges and over the entire service life of the fuel injection system.

The predetermined limit value can be selected freely to suit the requirements of the fuel injection system. The predetermined limit value can also be stored in memory in the form of a performance graph in the control unit of the engine. It has proved advantageous if the limit value is selected such that it amounts to approximately 30% of the theoretical pumping quantity of the high-pressure fuel pump.

Setting a defined leakage of the pressure regulating valve is especially simple if the closing force of the pressure control valve, in particular a pressure control valve embodied as a seat valve, is reduced so far that the desired leakage occurs at the pressure regulating valve.

The closing force of the pressure regulating valve can for instance be controlled by varying the ratio between the periods of time in which the pressure regulating valve is currentless and the periods of time in which current is supplied to the pressure regulating valve.

It is advantageous if the triggering of the pressure regulating valve is effected as a function of a set-point pressure in the common rail and as a function of an rpm at which the high-pressure fuel pump is driven.

To avoid the occurrence of impermissible operating states in the fuel injection system, in a further advantageous feature of the method of the invention, this method is employed only if the fuel quantity pumped by the high-pressure fuel pump is greater than the fuel quantity consumed by the injectors. If this condition is not met, then leakage at the pressure regulating valve would lead to an inadequate supply to the injectors, which must be avoided under all circumstances.

The triggering of the pressure regulating valve for setting a defined leakage can be set via a controller and/or one or more performance graphs.

The method of the invention can also be realized in the form of a computer program, in particular a computer program that can be stored in memory on a storage medium, or a control unit for a fuel injection system of an internal combustion engine.

BRIEF DESCRIPTION OF THE DRAWINGS

Further advantages and advantageous features of the invention can be learned from the description contained herein below, taken in conjunction with the drawings, in which.

DESCRIPTION OF THE PREFERRED EMBODIMENTS

Figure 1:
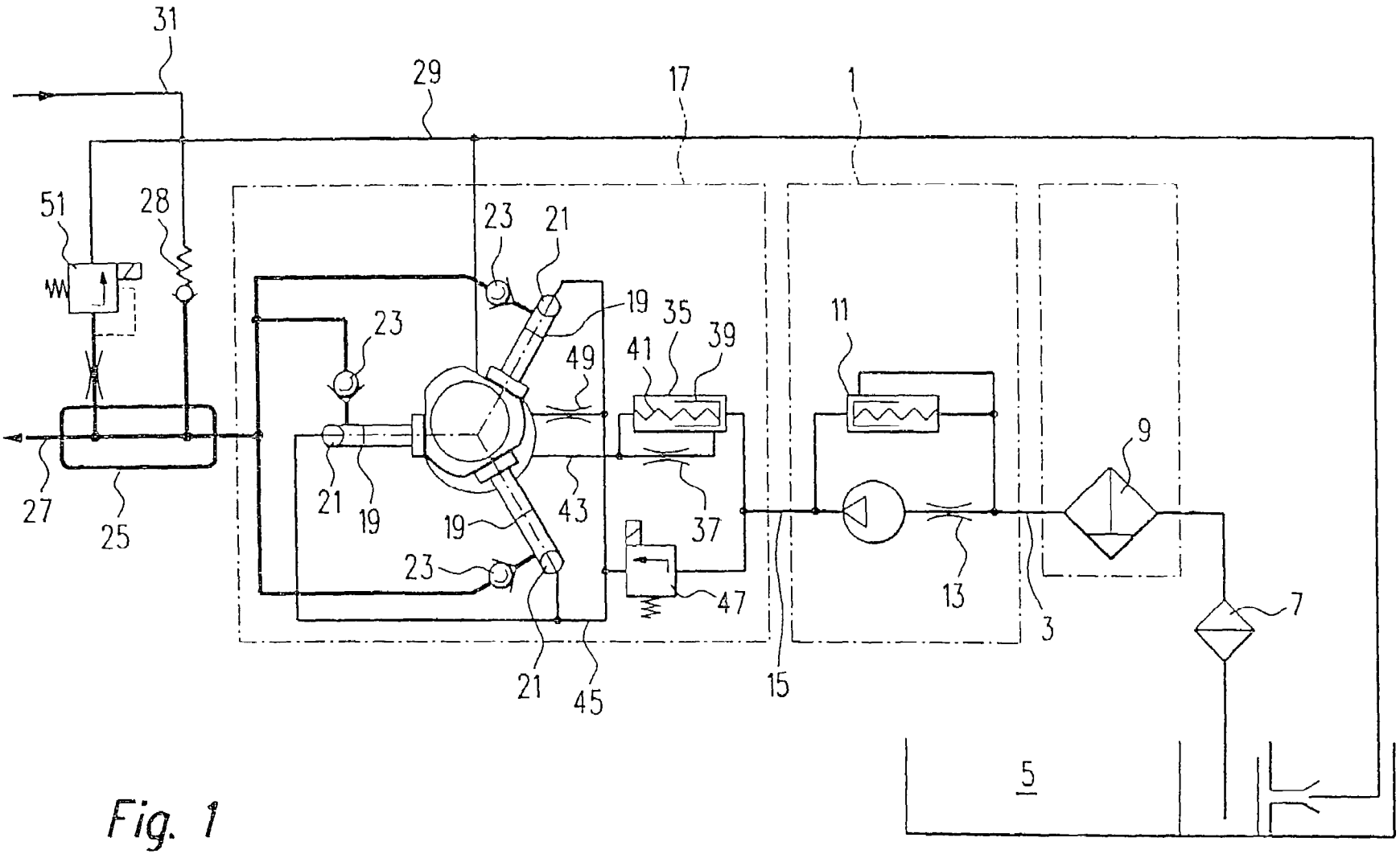
FIG. 1, is a schematic illustration of a fuel injection system for performing the method of the invention.

In FIG. 1, a common rail injection system of the prior art is shown schematically. The injection system described in conjunction with FIG. 1 serves to explain the problem which the invention addresses; however, the invention is not limited to injection systems of this type. The lines under high pressure in the fuel injection system are shown in heavy lines in FIG. 1, while the low-pressure regions of the fuel injection system are represented by fine lines.

A prefeed pump 1, via an inlet line 3, aspirates fuel, not shown, from a tank 5. The fuel is filtered in a prefilter 7 and a filter with a water separator 9.

The prefeed pump 1 may be embodied as a geared pump and has a first overpressure valve 11. On the intake side, the prefeed pump is throttled by a first throttle 13. A compression side 15 of the prefeed pump 1 supplies a high-pressure fuel pump 17 with fuel.

The high-pressure fuel pump 17 is embodied as a radial piston pump, with three pump elements 19, and it drives the prefeed pump 1. Alternatively, the prefeed pump 1 may be driven electrically, for instance. One intake valve 21 is provided on the intake side of each of the pump elements 19.

On the compression side of the pump elements 19, one check valve 23 each is provided, which prevents the fuel at high pressure, which has been pumped into a common rail 25 by the pump elements 19, from being able to flow back into the pump elements 19.

The common rail 25 supplies one or more injectors, not shown in FIG. 1, with fuel via a high-pressure line 27. The pressure regulating valve 51 moreover prevents excessively high pressures in the high-pressure region of the fuel system. Via a return line 29 and a leak fuel line 31, the leakage and the control quantities from the injector or injectors, not shown, are returned to the tank 5. For pressure regulation, a rail pressure sensor, not shown, is needed and is typically disposed on the common rail 25.

The high-pressure fuel pump 17 is supplied with fuel for the pump elements 19 on the one hand and with fuel for lubrication on the other by the prefeed pump 1. The fuel quantity that serves to lubricate the high-pressure fuel pump 17 is controlled via a first control valve 35 and a second throttle 37.

The high-pressure fuel pump 17 also supplies the pump elements 19 with fuel, via a distribution line 45. For regulating the pumping quantity of the high-pressure fuel pump 17, a metering valve 47 is provided between the compression side 15 of the prefeed pump 1 and the distribution line 45. The metering valve 47 is a flow valve, which is triggered by a control unit, not shown, of the fuel injection system. The pump elements 19 are thus throttled on the intake side via the metering valve 47.

In the overrunning mode, that is, for instance when a motor vehicle is driving downhill, no fuel should flow into the pump elements 19, nor should any fuel be injected into the combustion chambers of the engine by the injectors, not shown. Since for reasons of production and function the metering valve 47 has a leak fuel quantity in the closed state and this quantity flows into the distribution line 45, then unless suitable provisions are made, a pressure would build up on the intake side of the pump elements 19 that is so high that during the intake stroke the pump elements open the intake valves 21 and aspirate fuel. The consequence would be that the pressure in the common rail 25 would rise impermissibly.

To prevent this, a third throttle 49 is provided, hereinafter also called a zero-feed throttle. By means of the zero-feed throttle 49, the fuel can flow out of the distribution line 45 into the crankcase of the high-pressure fuel pump 17 and can be used there to lubricate the high-pressure fuel pump 17. As a result of the outflow of fuel through the zero-feed throttle 49, the aforementioned pressure buildup in the distribution line 45 in the overrunning mode is prevented because of the leakage from the closed metering valve 47.

The pressure in the common rail 25 can be regulated both via a pressure regulating valve 51, which can also be embodied as a flow valve, and via the metering valve 47. The pressure regulating valve 51 and the metering valve 47 are likewise triggered by the control unit, not shown.

In FIG. 2, two exemplary embodiments of pump elements 19 of a high-pressure fuel pump 17 are shown schematically.

Figure 2A:
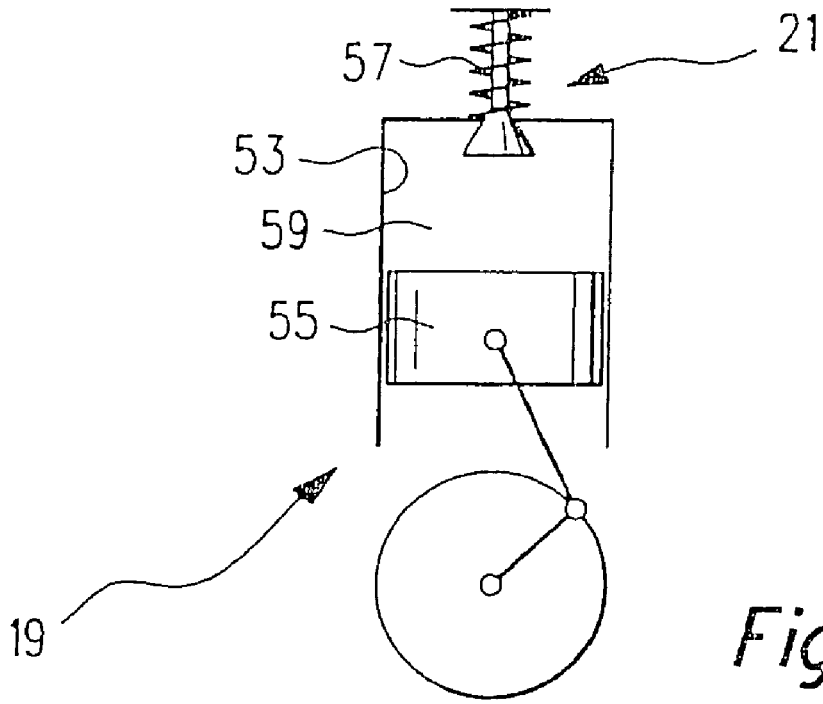
FIG. 2. is a highly simplified illustration of a pump element with an intake valve spring located in the pumping chamber.

In FIG. 2*a*, a pump element 19 is shown, greatly simplified, and essentially comprising a cylindrical bore 53, a pump piston 55 that oscillates in the cylindrical bore 53, and an intake valve 21. A check valve 23 (see FIG. 1) is not shown, although it is necessary for the function of the pump element 19.

In the exemplary embodiment of FIG. 2*a*, an intake valve spring 57 of the intake valve 21 is disposed outside a pumping chamber 59 that is defined by the cylindrical bore 53 and the pump piston 55. In this design, the idle volume of the pumping chamber 59 can be kept very small, which has a favorable effect on the efficiency of the high-pressure fuel pump 17. However, in a high-pressure fuel pump 17 that comprises a plurality of pump elements 19 as in FIG. 2*a*, the pumping performance of the individual pump elements is quite variable in the partial-load range, which leads to unwanted pressure fluctuations in the common rail and to an unequal power consumption by the high-pressure fuel pump.

Figure 2B:
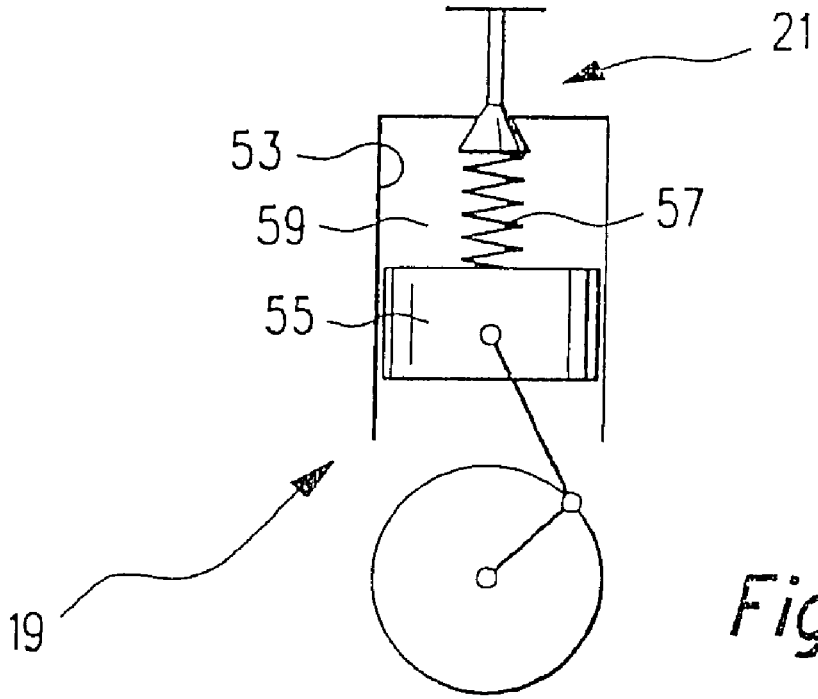

In FIG. 2*b*, a different exemplary embodiment of a pump element 19 is shown, whose operating performance in the partial-load range is markedly improved over the exemplary embodiment of FIG. 2*a*.

In the exemplary embodiment of FIG. 2*b*, the intake valve spring 57 is braced on the pump piston 55. In this design, the idle volume of the pumping chamber 59 is necessarily markedly greater than in the exemplary embodiment of FIG. 2*a*, which has the negative effect of poorer efficiency of the high-pressure fuel pump. However, in a high-pressure fuel pump 17 that comprises a plurality of pump elements 19 as in FIG. 2*b*, the pumping performance of the individual pump elements in the partial-load range is virtually identical, so that the pressure fluctuations in the common rail are slight and the power consumption of the high-pressure fuel pump 17 is very uniform.

With the method of the invention, it is possible for instance to operate high-pressure fuel pumps 17 with pump elements 19 in accordance with the exemplary embodiment of FIG. 2*a* in such a way that its pumping performance is equivalent to pump elements of FIG. 2*b*, without sacrificing efficiency.

Figure 3:
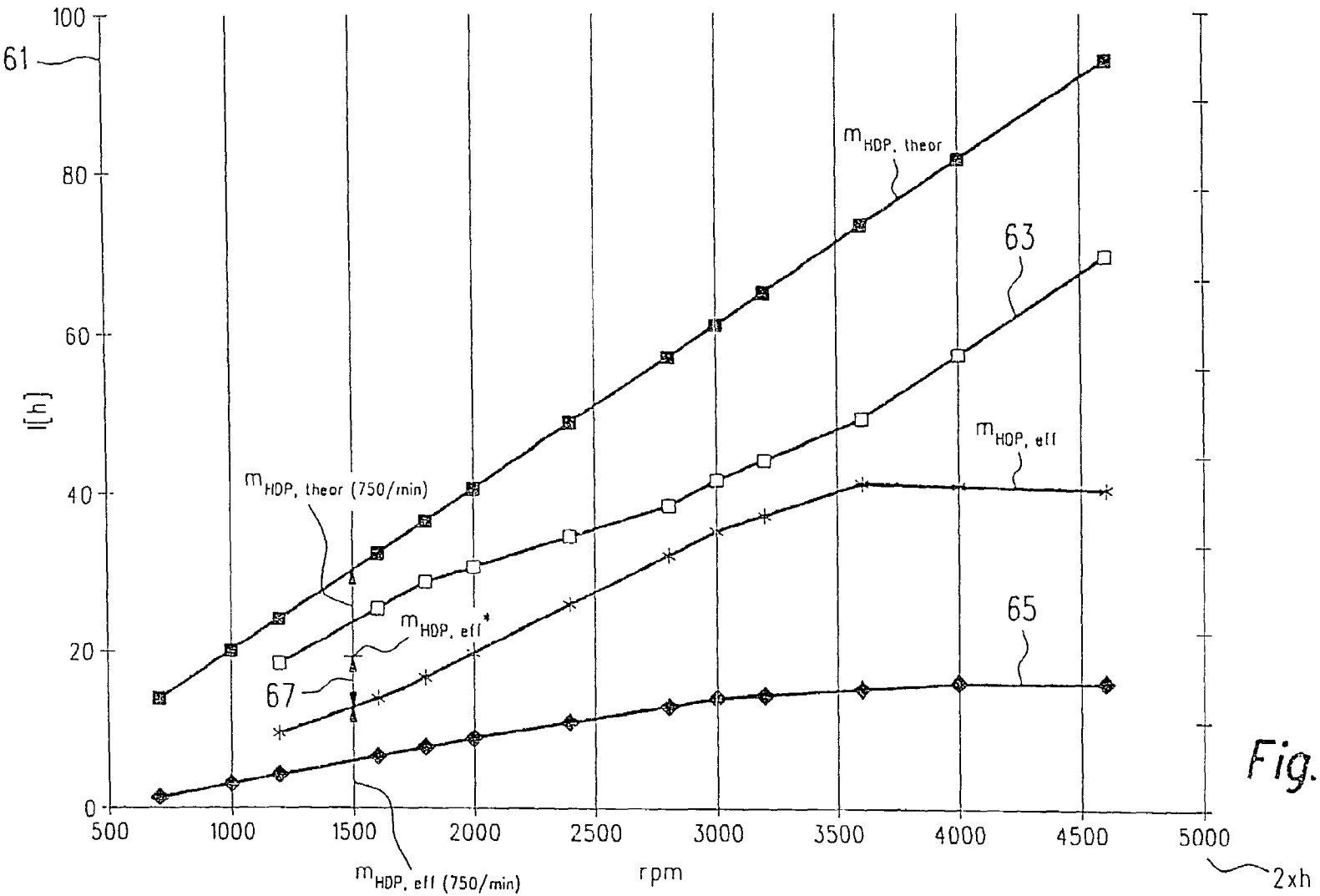
FIG. 3. is a graph showing quantity in a fuel injection system as a function of the engine rpm.

In FIG. 3, a graph is shown of quantity in a fuel injection system which substantially comprises the injectors as consumers and a high-pressure fuel pump as a pumping device. The fuel injection system is operated in the way known from the prior art.

In this exemplary embodiment, the high-pressure fuel pump 17 has pump elements 19 as in the exemplary embodiment of FIG. 2*a*; that is, the intake valve spring 57 is disposed outside the pumping chamber 59. In FIG. 3, the pumping rate 61 in liters/hour is shown over twice the rpm n of the high-pressure fuel pump 17 (see FIG. 1). A line marked $m_{HDP,\,theor}$ in FIG. 3 represents the theoretical pumping quantity of the high-pressure fuel pump. The theoretical pumping quantity $m_{HDP,\,theor}$ increases linearly with the rpm.

Below the line $m_{HDP,\,theor}$, the maximum pumping quantity of the high-pressure fuel pump is plotted, taking leakage, wear and other factors into account. This maximum pumping quantity is identified by reference numeral 63 in FIG. 3.

In FIG. 3, the fuel demand of the engine is plotted in simplified form as a line 65, as a function of the rpm and assuming a defined load state. Since the injectors, which inject the fuel into the combustion chambers of the engine but in turn have some leakage and require a control quantity for opening and closing the nozzle needles, the actual fuel consumption of the injectors is greater than the fuel demand of the engine. The high-pressure fuel pump must satisfy the actual fuel demand of the injectors. The actual fuel demand of the injectors is therefore equal to the effective pumping quantity $m_{HDP,\,eff}$ of the high-pressure fuel pump. At all rpm levels, the line $m_{HDP,\,eff}$ is above the line 65 that represents the fuel demand of the engine.

If at an engine speed of 1500 rpm, for instance, corresponding to a rotary speed of the high-pressure pump of 750 rpm at a step-up ratio of 1:4, the actual pumping quantity $m_{HDP,\,eff}$ is less than an applicable minimum pumping quantity $m_{Min}$, then in the method of the invention the pressure regulating valve 51 is triggered such that a defined leakage occurs at the pressure regulating valve 51. The minimum pumping quantity $m_{Min}$ can for instance amount to 30% of the theoretical pumping quantity $m_{HDP,\,theor}$.

This leakage increases the pumping quantity of the high-pressure fuel pump and thus the fill factor of the pump elements 19 of the high-pressure fuel pump 17. In FIG. 3, the maximum allowable leakage at the pressure regulating valve 51 for this operating point is represented by a double arrow 67.

The minimum pumping quantity $m_{Min}$ depends on the operating performance of the high-pressure pump 17 and can therefore be stored in memory, for instance in a stored characteristic curve or a performance graph. Ascertaining the operating-point-dependent minimum pumping quantity $m_{Min}$ can be done by measurements or calculations.

It is understood that in the application of the method of the invention, care must be taken that the pumping quantity $m_{HDP,\,eff}$, which is composed of the fuel consumption $m_{HDP,\,eff}$ of the injectors plus the operating-point-dependent leakage 67, be in no case greater than the maximum pumping quantity 63 of the high-pressure fuel pump.

It becomes clear from FIG. 3 that in the rpm ranges of the engine between 1000 and 2000 rpm, corresponding to a rotary speed of the high-pressure fuel pump 17 of 500 to 1000 rpm, the spacing in the vertical direction between the line $m_{HDP,\,eff}$ and the line 63 is relatively great. In this rpm range, in which the equal pumping of the pump elements 19 of the high-pressure fuel pump 17 is relatively poor without the application of the method of the invention, a relatively great leakage 67 can therefore be set at the high-pressure valve 51, and thus the desired equal pumping of the pump elements 19 can be realized by the method of the invention simply and without additional engineering expense.

If the pressure regulating valve 51 has a ball-shaped valve member which is pressed into a valve seat by a magnet armature in order to close the pressure regulating valve 51 (this situation is not shown in FIG. 1), the leakage 67 can be adjusted by suitably varying the ratio of the periods of time within which the magnet armature of the pressure regulating valve 51 is supplied with current to the periods of time within which the magnet armature is without current. In other constructions of pressure regulating valves 51, the desired defined leakage 57 can be adjusted by a suitably different triggering of the pressure regulating valve 51.

Figure 4:
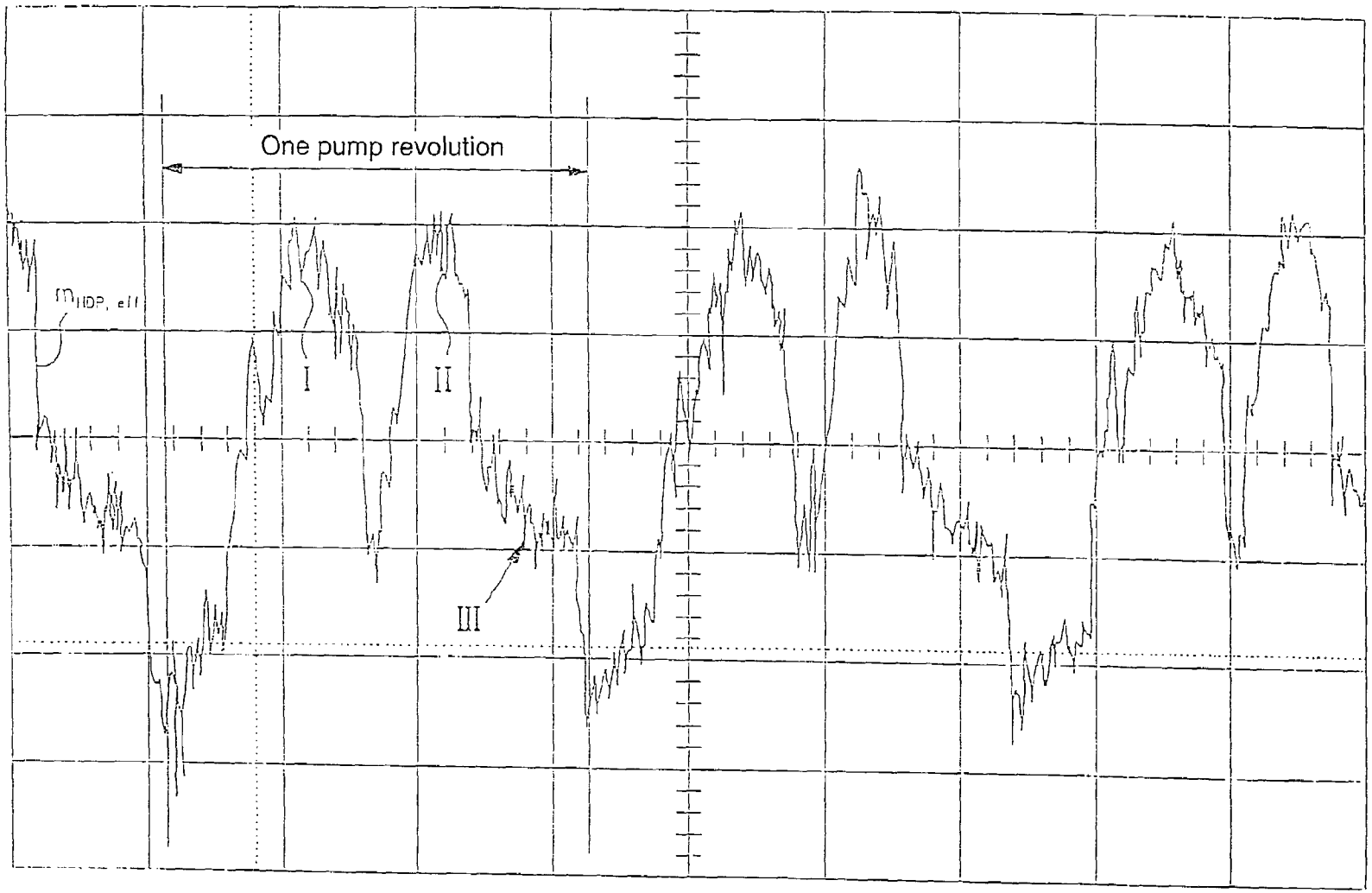
FIG. 4. is shows the pressure course in the rail and the pumping performance of the high-pressure fuel pump without application of the method of the invention.

In FIG. 4, the course of the pressure in the common rail 25 of a radial piston pump with three pump elements 19 is shown, without the application of the method of the invention. In FIG. 4, one revolution of the high-pressure fuel pump 17 is bounded by two vertical lines. It can be seen clearly from this that of the three pump elements, only two pump elements make a significant contribution to the total pumping quantity of the high-pressure fuel pump. These contributions are marked in FIG. 4 by I and II. The contribution III of the third pump element, conversely, is negligibly slight. FIG. 4 shows a fuel injection system of the prior art, without application of the method of the invention.

Figure 5:
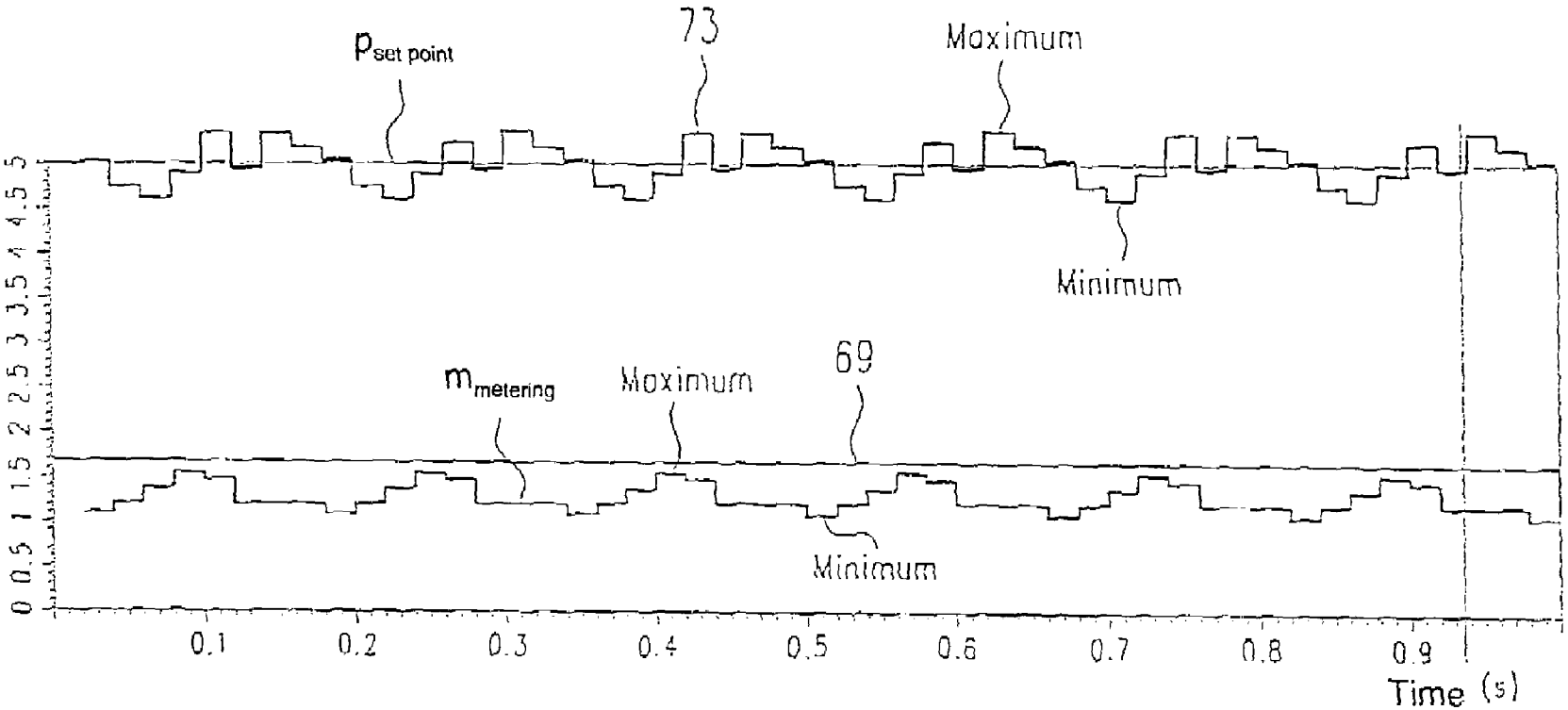
FIG. 5. is shows the pressure course in the common rail and the pumping performance of the high-pressure fuel pump without application of the method of the invention.

In FIG. 5, the same fuel injection system, without application of the method of the invention, is shown in the form of a graph. In FIG. 5, the volumetric flow $M_{metering}$ over time is represented by the metering valve 47 (see FIG. 1). A line 69 represents the duty cycle at the pressure regulating valve 51. The duty cycle is a measure for the closing force with which the valve member of the pressure regulating valve 51 is pressed against its sealing seat.

A further line shows the set-point value of the pressure $p_{setpoint}$ in the common rail 25. Both the set-point value $p_{set\ point}$ and the duty cycle 69 are constant over time in FIG.

5. A line 73 represents the measured actual pressure in the common rail. It becomes clear from FIG. 5 that both the fuel quantity $m_{metering}$ flowing through the metering valve 47 and the pressure 73 in the common rail 25 are subject to relatively major fluctuations over time.

Figure 6:
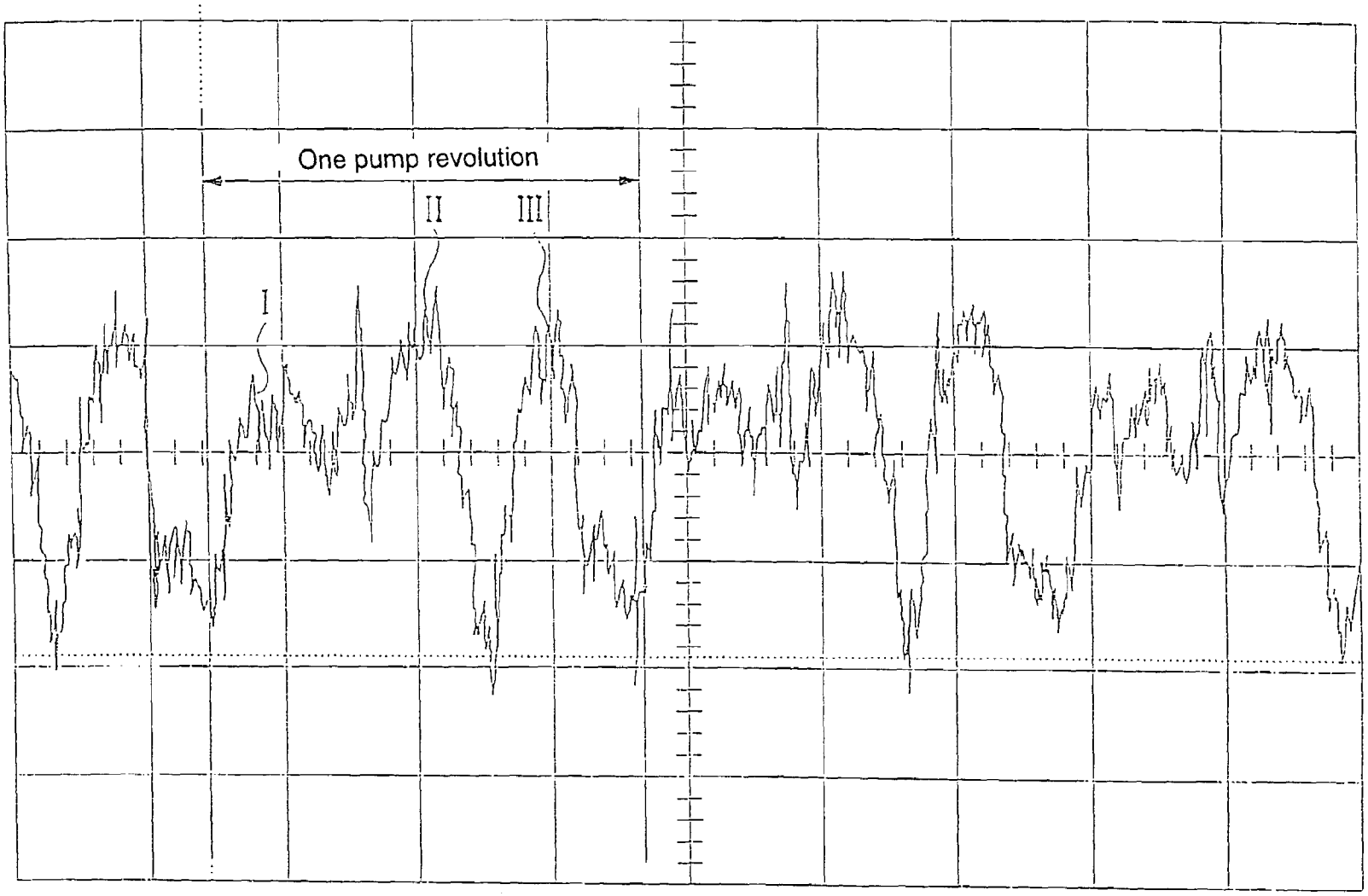
FIG. 6. is shows the pressure course in the rail and the pumping performance of the high-pressure fuel pump with application of the method of the invention.

In FIG. 6, the course of pressure of the high-pressure fuel pump of the same fuel injection system as in FIG. 4, but with application of the method of the invention, is shown. It becomes clear from this that as a result of the defined leakage of the pressure regulating valve 51, the pumping quantity of the high-pressure fuel pump 17 has been increased so far that all three pump elements make an approximately equal contribution to the total pumping quantity of the high-pressure fuel pump 17 (see I, II and III in FIG. 6).

Figure 7:
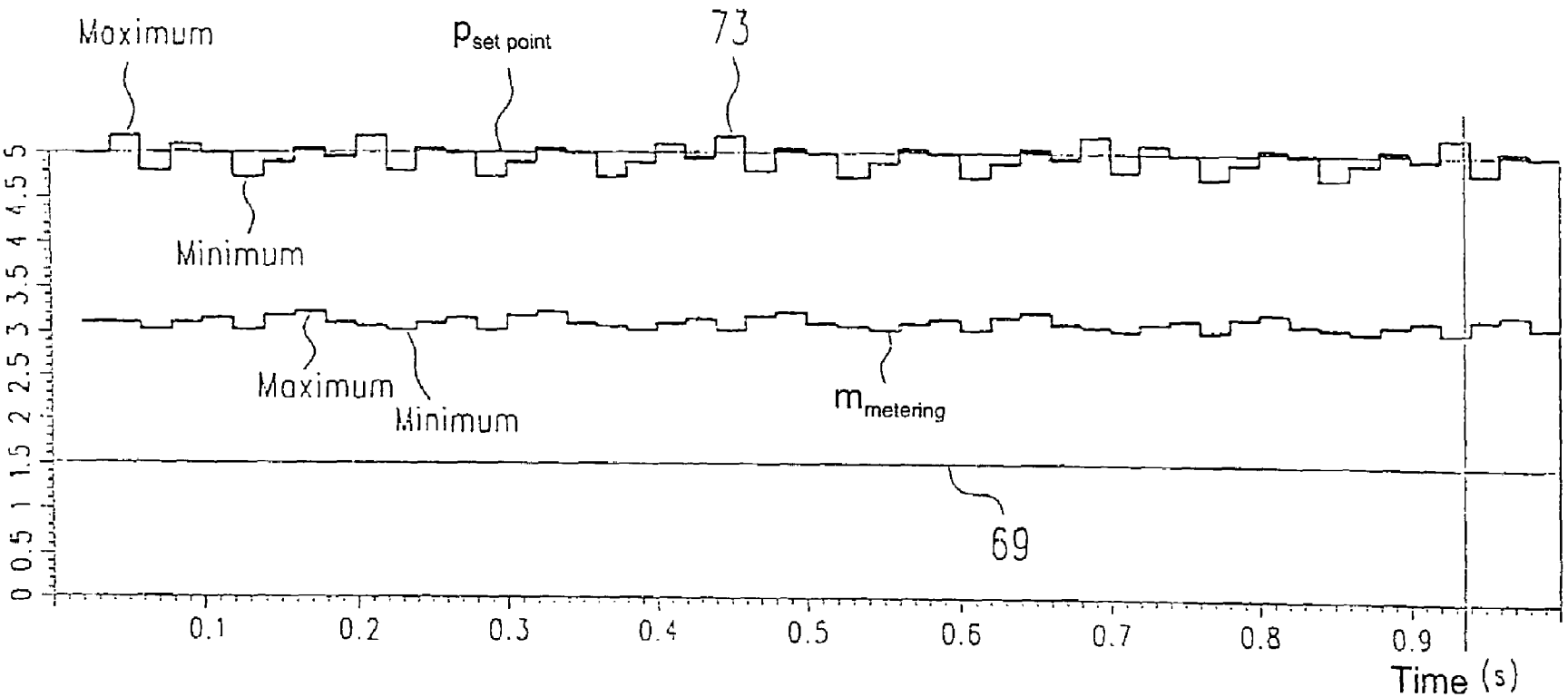
FIG. 7. is shows the pressure course in the common rail and the pumping performance of the high-pressure fuel pump with application of the method of the invention.

In FIG. 7, the effects of the application of the method of the invention both to the fuel injection system, in particular to the pumping quantity $m_{metering}$ of the high-pressure fuel pump, and to the actual pressure 73 in the common rail 25 are clearly apparent. Comparing FIGS. 5 and 7 clearly shows that the duty cycle 69 has been reduced by the application of the method of the invention, and as a consequence, the quantity $m_{metering}$ pumped by the high-pressure fuel pump has increased markedly. The differences between the maximum and minimum pumping quantity $m_{metering}$ have been reduced markedly as a result of applying the method of the invention. As a consequence, the driving power demand of the high-pressure fuel pump 17 has been made more uniform, which has a favorable effect on the quietness of operation of the engine.

The quality of regulation of the actual pressure 73 in the common rail 25 has also improved greatly as a result of the application of the method of the invention. This can be seen from the comparison of FIGS. 7 and 5, showing that the differences between the maximum value and the minimum value are reduced.

By the application of the method of the invention, it has been possible to reduce the differences in the rail pressure between the maximum and minimum, in a tested fuel injection system, from 38 bar to 24 bar. No change in the fuel injection system is required for applying the method of the invention; only the software in the control unit has to be adapted accordingly.

Figure 8:
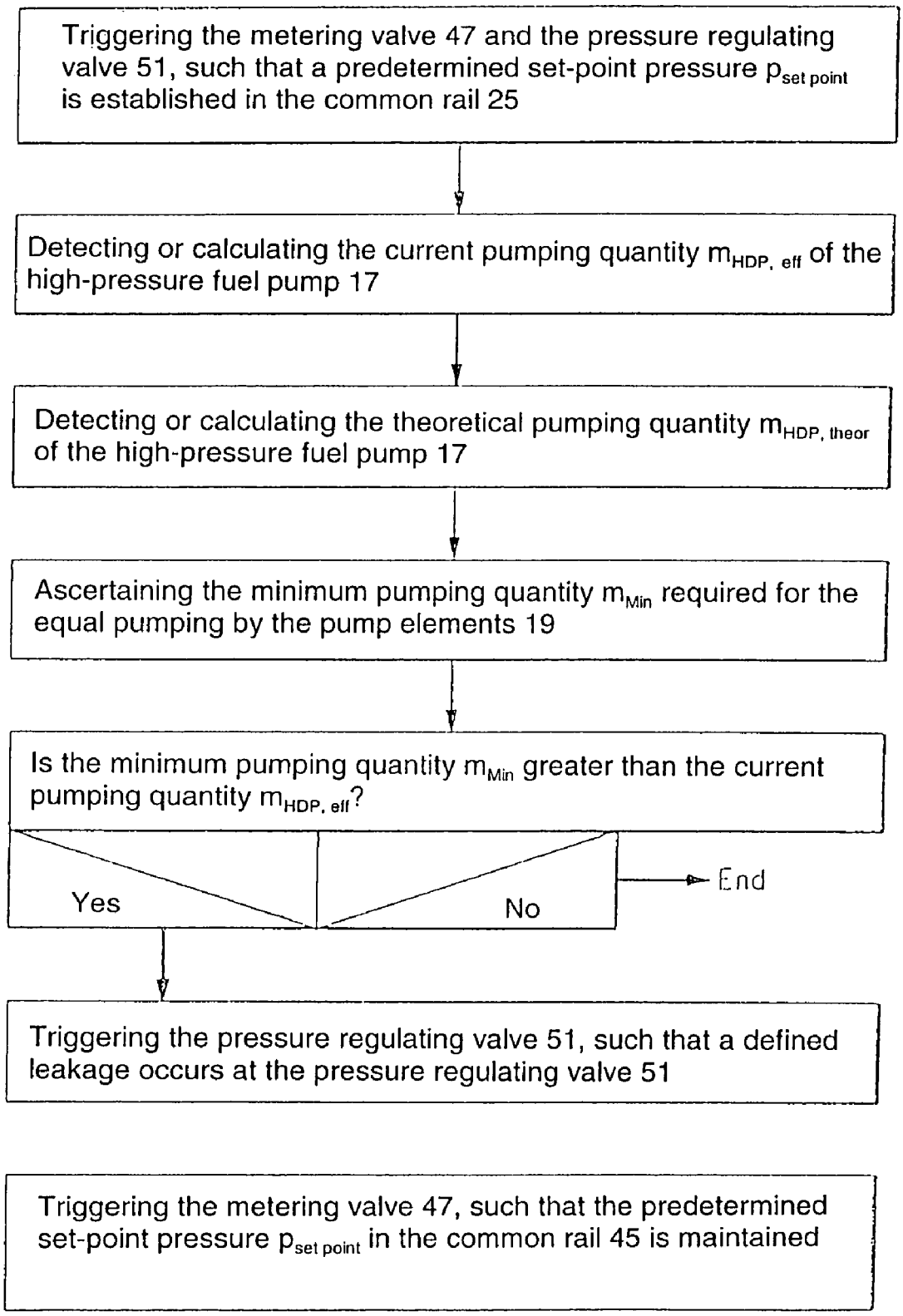
FIG. 8. is a flow chart of a variant of the method of the invention.

In FIG. 8, a flow chart of an exemplary embodiment of the method of the invention is shown. In a first step, the metering valve 47 and the pressure regulating valve 51 are triggered such that a predetermined set-point value is established in the common rail 25. By way of a characteristic curve, for instance, as a function of the engine rpm or pump rpm, a minimum pumping quantity $m_{Min}$ or a percentage wise minimum filling of the pump is stored in memory. This is multiplied for instance by the theoretical pumping volume $m_{HDP,\ theor}$ of the high-pressure fuel pump 17, and after that the outcome is subtracted from the current pumping quantity $m_{HDP,\ eff}$ of the pump. The difference in volumetric flow is converted, for instance via a controller or one or more performance graphs, into a controlling variable for the pressure regulating valve 51. If the current pumping quantity $m_{HDP,\ eff}$ of the high-pressure fuel pump 17 is less than the applied minimum pumping quantity $m_{Min}$, then the controlling variable or the duty cycle at the pressure regulating valve is reduced accordingly. Depending on the change in the controlling variable in the pressure regulating valve 51 and consequently the change in leakage at the pressure regulating valve 51, the pressure in the common rail 25 will vary. The increase in leakage of the pressure regulating valve 51 or the pressure change in the common rail 25 is compensated for, as the metering valve 47 is opened farther, by way of the controlling variable of the metering valve 47. If the current pumping quantity of the high-pressure fuel pump 17 is greater than the applied minimum pumping quantity $m_{Min}$, then the pressure regulating valve 51 either remains closed or is thereupon closed.

The triggering of the pressure regulating valve 51 can be effected for instance as a function of the controlling variable of the metering valve, of the set-point pressure in the common rail 25, and of an rpm, that is, the pump or engine rpm, at which the high-pressure fuel pump 17 is driven.

The foregoing relates to preferred exemplary embodiments of the invention, it being understood that other variants and embodiments thereof are possible within the spirit and scope of the invention, the latter being defined by the appended claims.

The invention claimed is:

1. A method for operating a fuel injection system of an internal combustion engine, having a high-pressure fuel pump (17), wherein the high-pressure fuel pump (17) has a plurality of pump elements (19), having a metering valve (47) disposed on the intake side of the high-pressure fuel pump (17), wherein the fuel quantity aspirated by the pump elements (19) can be controlled or regulated by the metering valve (47), having a common rail (25), and having a pressure regulating valve (51), wherein the pressure in the common rail (25) is controlled or regulated by the pressure regulating valve (51), the method comprising the steps of detecting or calculating the pumping quantity ($m_{HDP,\ eff}$) pumped by the high-pressure fuel pump (17);

triggering the pressure regulating valve (51), if the pumping quantity ($m_{HDP,\ eff}$) is less than a predetermined limit value ($m_{Grenz}$), so that a defined leakage occurs at the pressure regulating valve (51); and triggering the metering valve (47) such that a predetermined set-point pressure ($P_{point}$) in the common rail is established.

2. The method of claim 1, wherein the limit value ($m_{Grenz}$) is freely selectable.

3. The method of claim 1, wherein the closing force of the pressure regulating valve (51) is reduced so far that the required defined leakage occurs at the pressure regulating valve (51).

4. The method of claim 2, wherein the closing force of the pressure regulating valve (51) is reduced so far that the required defined leakage occurs at the pressure regulating valve (51).

5. The method of claim 3, wherein the closing force of the pressure regulating valve (51) is controlled by varying the ratio between the periods of time in which the pressure regulating valve (51) is currentless and the periods of time in which current is supplied to the pressure regulating valve (51).

6. The method of claim 4, wherein the closing force of the pressure regulating valve (51) is controlled by varying the ratio between the periods of time in which the pressure regulating valve (51) is currentless and the periods of time in which current is supplied to the pressure regulating valve (51).

7. The method of claim 1, wherein the triggering of the pressure regulating valve (51) is effected as a function of a set-point pressure in the common rail (25) and as a function of an rpm at which the high-pressure fuel pump (17) is driven, or the engine rpm.

8. The method of claim 2, wherein the triggering of the pressure regulating valve (51) is effected as a function of a set-point pressure in the common rail (25) and as a function of an rpm at which the high-pressure fuel pump (17) is driven, or the engine rpm.

9. The method of claim 3, wherein the triggering of the pressure regulating valve (51) is effected as a function of a set-point pressure in the common rail (25) and as a function of an rpm at which the high-pressure fuel pump (17) is driven, or the engine rpm.

10. The method of claim 5, wherein the triggering of the pressure regulating valve (51) is effected as a function of a set-point pressure in the common rail (25) and as a function of an rpm at which the high-pressure fuel pump (17) is driven, or the engine rpm.

11. The method of claim 1, wherein the method is employed only if the current pumping quantity ($m_{HDP,\ eff}$) of the high-pressure fuel pump (17) is less than the applied limit value ($m_{Grenz}$).

12. The method of claim 2, wherein the method is employed only if the current pumping quantity ($m_{HDP,\ eff}$) of the high-pressure fuel pump (17) is less than the applied limit value ($m_{Grenz}$).

13. The method of claim 1, wherein the triggering of the pressure regulating valve (51) is stored in memory in one or more performance graphs.

14. The method of claim 2, wherein the triggering of the pressure regulating valve (51) is stored in memory in one or more performance graphs.

15. The method of claim 1, wherein the triggering of the pressure regulating valve (51) is effected by means of a controller.

16. The method of claim 1, wherein the pumping quantity ($m_{HDP,\ eff}$) of the high-pressure fuel pump (17) is ascertained from the fuel quantity flowing through the metering valve (47).

17. The method of claim 1 performed by a computer program stored in the memory of a computer storage medium.

18. A control unit for a fuel injection system of an internal combustion engine suitable for performing a method of claim 1.

* * * * *